US005749115A

United States Patent [19]

Franke

[11] Patent Number: 5,749,115

[45] Date of Patent: May 12, 1998

[54] ROTATABLE HEAD HAIRBRUSH

[76] Inventor: John Franke, 1200 Garin Ave., Hayward, Calif. 94544-6820

[21] Appl. No.: 549,012

[22] Filed: Oct. 27, 1995

Related U.S. Application Data

[63] Continuation-in-part of Ser. No. 239,505, May 9, 1994, Pat. No. 5,502,860.

[51] Int. Cl.[6] ..... A46B 3/70; A46B 7/02

[52] U.S. Cl. ..... 15/160; 15/172; 15/145; 15/176.1; 15/176.6

[58] Field of Search ..... 15/172, 171, 184, 15/185, 159.1, 160, 164, 201, 144.1, 143.1, 176.1, 145, 400, 407, 398, 399; 132/135, 151

[56] References Cited

U.S. PATENT DOCUMENTS

| | | | |
|---|---|---|---|
| 882,021 | 3/1908 | Schigelinsky | 15/172 |
| 1,968,303 | 7/1934 | McMath | 15/172 |
| 2,039,052 | 4/1936 | Beck et al. | 15/160 |
| 2,247,003 | 6/1941 | Smith et al. | 15/185 |
| 2,688,971 | 9/1954 | Daniels et al. | 128/393 |
| 3,340,556 | 9/1967 | Allen | 15/159 |
| 3,835,869 | 9/1974 | Newman et al. | 132/9 |
| 3,843,990 | 10/1974 | Lardenois | 15/159 R |
| 3,965,527 | 6/1976 | George | 15/396 |
| 3,968,536 | 7/1976 | Laighton et al. | 15/187 |
| 4,333,199 | 6/1982 | Del Rosario | 15/172 |
| 4,656,684 | 4/1987 | Tewett | 15/27 |
| 4,691,405 | 9/1987 | Reed | 15/201 |
| 5,333,345 | 8/1994 | O'Donnell | 15/159.1 |
| 5,502,860 | 4/1996 | Franke | 15/160 |

FOREIGN PATENT DOCUMENTS

| | | |
|---|---|---|
| 2927887 | 1/1981 | Germany . |
| 1158936 | 7/1969 | United Kingdom . |

*Primary Examiner*—Gary K. Graham
*Attorney, Agent, or Firm*—John D. Gugliotta

[57] ABSTRACT

A hairbrush is disclosed having an elongated, generally hollowed handle having a receiving cavity and a separate brush head having a connection end. At the inside base of the receiving cavity is a first blade slot for retaining one end of a flat, elongated spring blade. The connection end of the brush head has a second blade slot for retaining the other end of the flat, elongated spring blade. A locking button retained slidably within a button slot which penetrates the handle engages into a slotted collar in which a locking slot is formed on the connection end of the brush head by a pair of rotation locking tabs. The impingement of the rotation locking tabs against the locking button thereby prevents rotational motion of the brush head relative to the handle. Finally, in order to prevent the brush head from fully rotating completely about the handle and thereby causing damage or breakage to the blade spring or other parts, a rotation limiting means is provided in its preferred embodiment as a rotation limiting pin protruding slightly into the receiving cavity and aligned with the brush head connection end at a point in close proximity to the slotted collar. When the brush head is rotated relative to the handle the impingement of the rotation locking tabs against the rotation limiting pin thereby prevents complete rotation of the brush head, and provides a limited range of rotatable motion in either direction.

5 Claims, 3 Drawing Sheets

ROTATABLE HEAD HAIRBRUSH

RELATED APPLICATIONS

This application is a continuation in part to application Ser. No. 08/239,505, filed on May 9, 1994, now U.S. Pat. No. 5,502,860.

BACKGROUND OF THE INVENTION

1. Field of the Invention

The present invention relates generally to hair maintenance and styling devices and, more particularly, to rotatable head hairbrushes.

2. Description of the Related Art

Problems occurring with the use of a stationary head hairbrush are well known to those with thick or tangled hair. The bristles of a stationary head hairbrush or comb often grab and pull such thick or tangled hair, causing both damage to the hair as well as inflicting pain to the individual.

A solution to this problem has been developed by hair care professionals, and involves a special wrist movement to provide a combination of brush rotation and movement with variable resistance, referred to in the hair care industry as "waving through the hair". However, such a movement is difficult to master and is even more difficult to use on oneself, particularly toward the back of the head and where left or right handedness makes such movement awkward.

Numerous attempts have been made to provide a solution for the foregoing problems. For example, in U.S. Pat. No. 3,843,990, issued in the name of Lardenois, a cylindrical hair brush is disclosed having the bristles supported on a sleeve made of elastically deformable supple material.

Also, in U.S. Pat. No. 4,656,684, issued in the name of Jewett, a tangle free blow-dry brush is disclosed which includes a rotating, lockable head. Such a brush, however, has a freely rotating head, which, while rotating rather than tugging at the hair, rotates freely when applying a conventional tugging motion and must be locked in order to remain functional.

Numerous attempts have been made to correct for the foregoing problems. However, none provide for an otherwise conventional hair care implement having a rotatable head which provides return torque, thereby allowing the brush head to automatically return to a brushing position.

Consequently, a need has been felt for providing an apparatus to overcome the problems associated with tangled and thick hair, while at the same time remaining functional for continued use after the hair is de-tangled or becomes otherwise more manageable.

SUMMARY OF THE INVENTION

It is therefore an object of the present invention to provide an improved hairbrush.

It is another object of the present invention to provide an improved hairbrush with a rotatable head.

It is another object of the present invention to provide an improved hairbrush with a rotatable head having a resistance torque means to provide a proportional resistance to any brushing motion.

It is yet another object of the present invention to provide an improved hairbrush with a rotatable head that can return to the original brushing position upon removal of any torsional forces upon the brush head.

It is a final object of the present invention to provide an improved rotatable head hairbrush which can be locked, thereby converting to and capable of being utilized as a conventional hairbrush.

It is a feature of the present invention to provide an improved hairbrush with a rotatable head which has a resistance torque means to provide a proportional resistance to any brushing motion, but can also be locked into a fixed position.

Briefly described according to the preferred embodiment of the present invention, a hairbrush is disclosed having an elongated, generally hollowed handle having a receiving cavity and a separate brush head having a connection end. At the inside base of the receiving cavity is a first blade slot for retaining one end of a flat, elongated spring blade. The connection end of the brush head has a second blade slot for retaining the other end of the flat, elongated spring blade. A locking means is provided in order to prevent the brush head from rotating, and a rotation limiting means is also incorporated in order to prevent the brush head from rotating too far relative to the brush handle.

An advantage of the present invention is that an improved hairbrush is provided with a rotatable head having a resistance torque means to provide a proportional resistance to any brushing motion.

Another advantage of the present invention is that an improved hairbrush is provided with a rotatable head that can return to the original brushing position upon removal of any torsional forces upon the brush head.

Yet another advantage of the present invention is that an improved rotatable head hairbrush is provided in which the head can be locked into a position fixed relative to the handle, thereby converting to and capable of being utilized as a conventional hairbrush.

A final advantage of the present invention is that a rotatable head hairbrush can be easily manufactured with few moving parts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
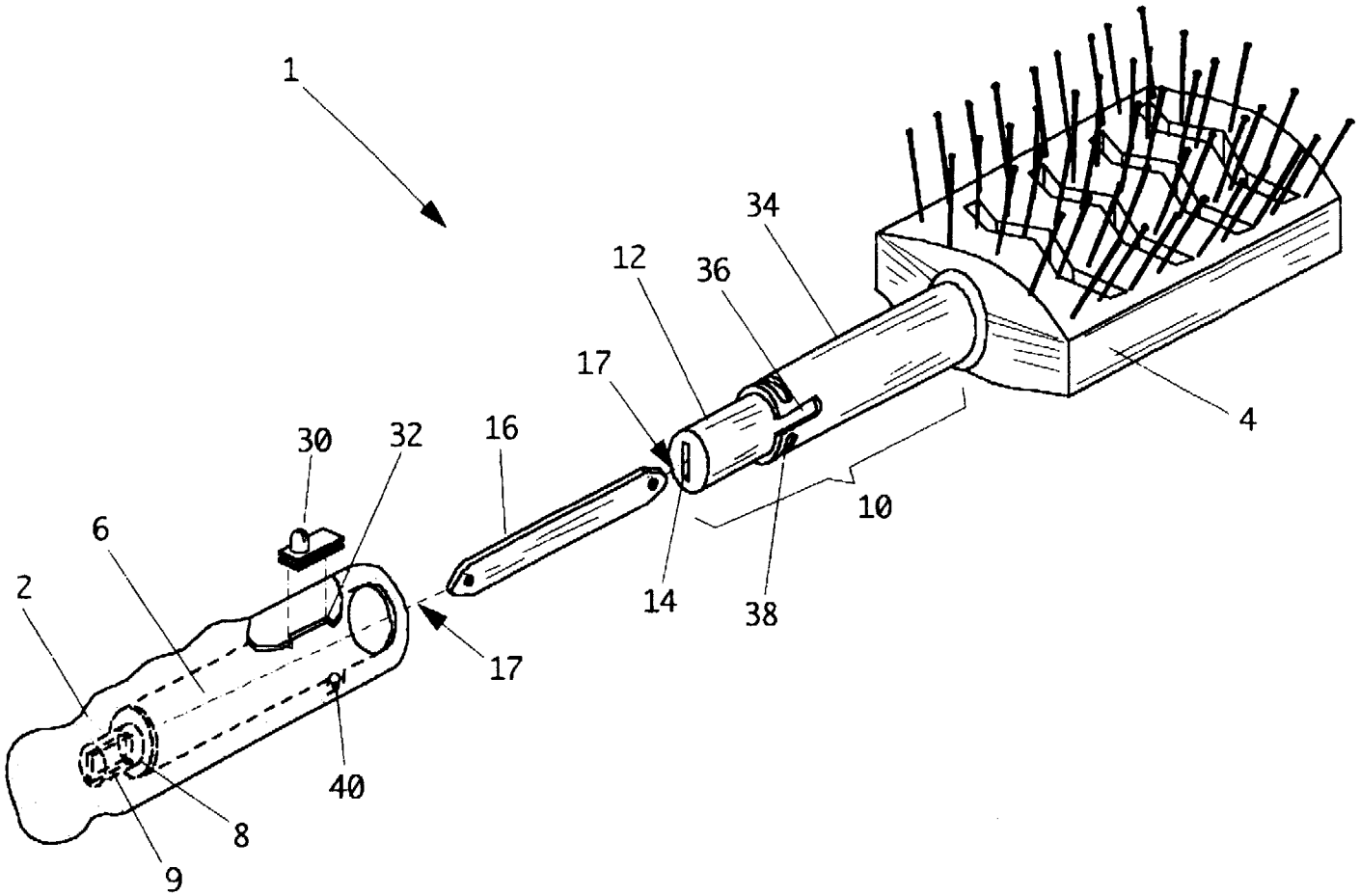
FIG. 1 is an exploded perspective view of a rotatable head hairbrush according to the preferred embodiment of the present invention.
Figure 2:
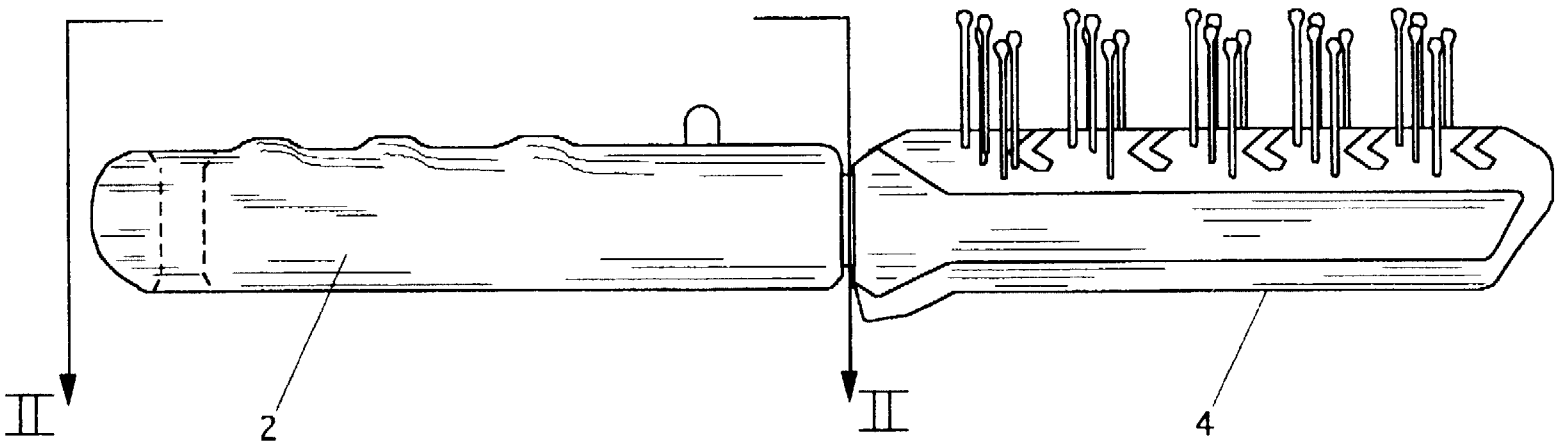
FIG. 2 is a side view thereof.

Referring to FIG. 1 and FIG. 2, a rotatable head hairbrush 1 is shown, according to the present invention, having a handle 2 and a brush head 4. The handle 2 is elongated and generally tubular, and forms a receiving cavity 6 therein. At a first base 8 of the receiving cavity 6 is a first blade slot 9. Similarly, the brush head 4 has a connection end 10 which is also elongated and generally tubular, and designed to insert within and rotate freely about said receiving cavity 6. The connection end 10 has a second base 12 containing a second blade slot 14.

Connecting the handle with the brush head is a spring blade 16. In its preferred embodiment the spring blade 16 is a thin, elongated, symmetric, flexible steel blade having a pair of embedding points 17. One end of the spring blade 16 inserts into the first blade slot 10 and is affixed to the handle 2. As the connection end 10 of the brush head 4 is inserted into the receiving cavity 6 of the handle 3, the other end of the spring blade 16 inserts into the second blade slot and is affixed to the brush head 2, thereby holding together the handle 2 and the brush head 4.

Because the brush head 4 is not directly affixed to the handle 2, it would remain freely rotatable within the receiving cavity 6. Therefore, the spring blade 16 provides a torsion means, allowing the brush head 4, when rotated relative to the handle 2, to be returned to its original starting position.

Figure 3:
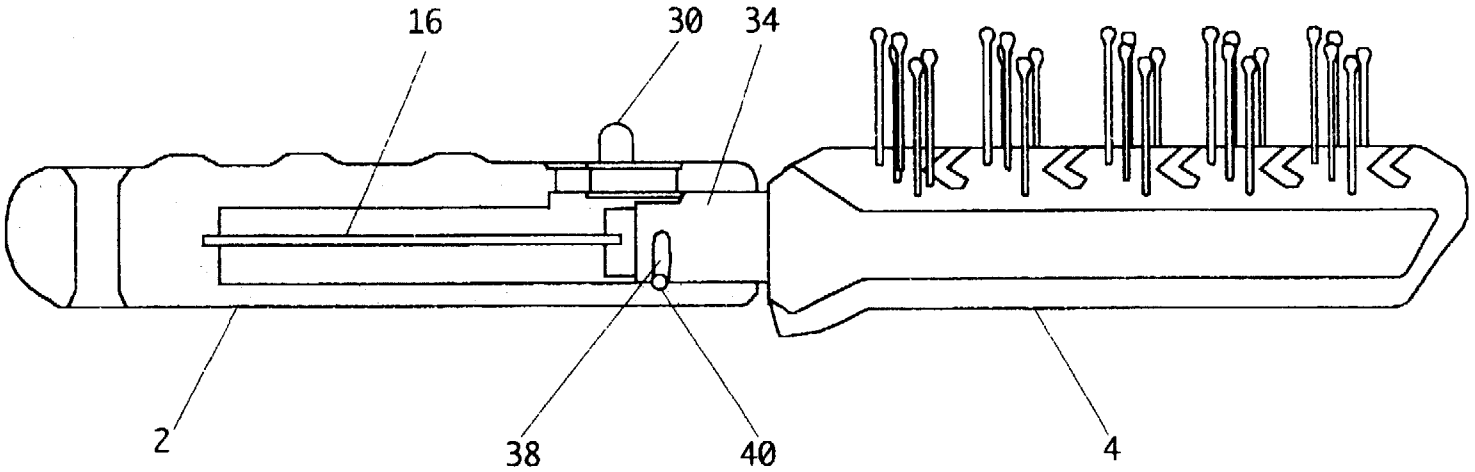
FIG. 3 is a cross sectional view thereof taken along lines II—II in FIG. 2.

Referring now to FIG. 1 and FIG. 3, a rotation limiting means and a head locking means are disclosed in further detail. At times when the user does not desire a brush with a rotatable head, he or she may wish to utilize the present invention as a standard brush. To provide such a function the preferred embodiment has a locking button 30 retained slidably within a button slot 32 which penetrates the handle 2. On the brush head 4, the connection end 10 has a slotted collar 34 in which a locking slot 36 is formed by a pair of rotation locking tabs 38. When fully assembled, the locking button 30 slides about within the button slot 32. When slid fully toward the brush head 4, the locking button 30 is received into the locking slot 36. The impingement of the rotation locking tabs 38 against the locking button 30 thereby prevents rotational motion of the brush head 4 relative to the handle 2. When slid fully away from the brush head 4, the locking button 30 is clear of the rotation locking tabs 38, and the brush head 4 remains rotatable relative to the handle 2, with the blade spring providing 16 resistance torque.

Finally, in order to prevent the brush head 4 from fully rotating completely about the handle 2 and thereby causing damage or breakage to the blade spring 16 or other parts, a rotation limiting means is provided in its preferred embodiment as a rotation limiting pin 40 protruding slightly into the receiving cavity 6. The rotation limiting pin 40 is aligned, when fully assembled, with the brush head connection end 10 at a point in close proximity to the slotted collar 34. When the brush head 4 is rotated relative to the handle 2, the impingement of the rotation locking tabs 38 against the rotation limiting pin 30 thereby prevents complete rotation of the brush head 4, and provides a limited range of rotatable motion in either direction.

The foregoing description is included to illustrate the operation of the preferred embodiment and is not meant to limit the scope of the invention. The scope of the invention is to be limited only by the following claims.

What is claimed is:

1. A Rotatable Head Hairbrush comprising:

a brush head having bristles and a connection end;

an elongated handle forming a hollowed receiving cavity and having an outer surface, an inner surface, and an inner base;

a flexible blade spring having a first connection tip affixed to said connection end of said brush head and a second connection tip affixed to said inner base within said receiving cavity of said handle, said flexible blade spring for producing a rotational torque means providing increasing resistance to and commensurate with increasing rotation of said brush head with respect to said handle; and locking means for temporarily preventing rotation of said brush head relative to said handle.

2. The Rotatable Head Hairbrush as described in claim 1, wherein said locking means comprises:

a button slot penetrating said outer surface and said inner surface of said handle;

a locking button retained slidably within said button slot, said locking button protruding from said inner surface and said outer surface; and a slotted collar surrounding said connection end, said slotted collar containing a locking slot for receiving and axially impinging against said locking button.

3. The Rotatable Head Hairbrush as described in claim 1, further comprising a rotation limiting means for preventing complete rotation of said brush head relative to said handle.

4. The Rotatable Head Hairbrush as described in claim 3, wherein said rotation limiting means comprises:

a rotation limiting pin penetrating into said inner surface of said handle; and a tabbed collar surrounding said connection end, said tabbed collar containing at least one locking tab impinging against said rotation limiting pin.

5. The Rotatable Head Hairbrush as described in claim 1, wherein said flexible blade spring further provides for said brush head to return to an original starting position upon removal of any rotational resistance forces from said brush head.

* * * * *